United States Patent [19]

Haswell, Jr. et al.

[11] Patent Number: 4,933,142

[45] Date of Patent: Jun. 12, 1990

[54] LOW CARBON PLUS NITROGEN FREE-MACHINING AUSTENITIC STAINLESS STEELS WITH IMPROVED MACHINABILITY AND CORROSION RESISTANCE

[75] Inventors: Walter T. Haswell, Jr., Jamesville, N.Y.; Kenneth E. Pinnow, Pittsburgh, Pa.; John J. Eckenrod, Coraopolis, Pa.; Geoffrey O. Rhodes, Saxonburg, Pa.

[73] Assignee: Crucible Materials Corporation, Pittsburgh, Pa.

[21] Appl. No.: 306,216

[22] Filed: Feb. 3, 1989

Related U.S. Application Data

[63] Continuation of Ser. No. 910,239, Sep. 19, 1986, abandoned.

[51] Int. Cl.[5] ..... C22C 38/40; C22C 38/60

[52] U.S. Cl. ..... 420/42; 420/49; 148/325; 148/327

[58] Field of Search ..... 420/42, 49, 87; 148/325, 327

[56] References Cited

U.S. PATENT DOCUMENTS

| | | | |
|---|---|---|---|
| 3,902,898 | 9/1975 | Denhard, Jr. et al. | 420/42 |
| 4,613,367 | 9/1986 | Eckenrod et al. | 420/42 |
| 4,769,213 | 9/1988 | Haswell et al. . | |
| 4,784,828 | 11/1988 | Eckenrod et al. | 420/42 |
| 4,797,252 | 1/1989 | Eckenrod et al. | 420/42 |

FOREIGN PATENT DOCUMENTS

| | | | |
|---|---|---|---|
| 48-27174 | 8/1973 | Japan | 420/49 |
| 55-122857 | 9/1980 | Japan | 420/42 |
| 61-3872 | 1/1982 | Japan | 420/49 |

OTHER PUBLICATIONS

Lula et al., "Residual and Minor Elements in Stainless Steels", *Metallurgy of Stainless Steel, pp. 14–1 to 14–2.*

*Primary Examiner*—Deborah Yee

*Attorney, Agent, or Firm*—Finnegan, Henderson, Farabow, Garrett & Dunner

[57] ABSTRACT

A low carbon plus nitrogen, free-machining, austenitic stainless steel having improved machinability and excellent corrosion resistance. The steel composition in weight percent is carbon plus nitrogen up to about 0.06, chromium 16 to 20, nickel 6 to 14, manganese up to 0.60, sulfur 0.15 to 0.50, silicon up to about 1, phosphorus up to about 0.20, molybdenum up to about 1 and balance iron.

16 Claims, No Drawings

LOW CARBON PLUS NITROGEN FREE-MACHINING AUSTENITIC STAINLESS STEELS WITH IMPROVED MACHINABILITY AND CORROSION RESISTANCE

This application is a continuation of application Ser. No. 910,239, filed Sept. 19, 1986, now abandoned.

BACKGROUND OF THE INVENTION

Conventional resulfurized free-machining austenitic stainless steels such as AISI Type 303 generally do not have sufficient corrosion resistance to allow them to be used in applications for acid soft drink or beverage syrups without significantly affecting the flavor of these products. The problem largely relates to the fact that the manganese or manganese-rich sulfides present in Type 303 are readily attacked in acid soft drink or beverage syrups. As a result of this attack, the local environment is so changed that the stainless steel adjacent to the manganese or manganese-rich sulfides corrodes, thereby releasing both sulfide and metal ions into the syrups and causing odor or taste problems. Passivating free-machining austenitic stainless steels such as AISI Type 303 in nitric acid solutions can minimize this difficulty by removing most of the manganese or manganese-rich sulfides from the surfaces of the articles machined from these steels before they are placed in service. However, the general corrosion resistance of the stainless steel matrix of AISI Type 303 is often insufficient, even in the absence of substantial sulfide dissolution, to avoid changes in the quality or taste of the beverage syrups. Thus, to improve the corrosion resistance of free-machining austenitic stainless steels in acid beverage syrups, the use of a more corrosion resistant free-machining additive along with improvements in the general corrosion resistance of the steel matrix in acid beverage syrups are necessary.

In this respect, U.S. Pat. No. 3,902,398 discloses that the corrosion resistance of resulfurized free-machining austenitic stainless steels can be significantly improved in acid beverage syrups by restricting their manganese content to a maximum of about 0.50% and by controlling the manganese to sulfur ratio such that chromium or chromium-rich sulfides are formed instead of manganese or manganese-rich sulfides. Chromium sulfides are more corrosion resistant than are manganese or manganese-rich sulfides in acid beverage syrups, and improve machinability but not nearly to the same extent as manganese or manganese-rich sulfides. As also disclosed in U.S. Patent 3,902,398, the loss in machinability related to the replacement of manganese or manganese-rich sulfides by chromium sulfides can be partly offset by lowering the carbon content of such steels to below about 0.035%.

In accordance with the present invention, the machinability of low-carbon resulfurized austenitic stainless steels containing chromium or chromium-rich sulfides can be substantially improved by controlling their carbon plus nitrogen content to lower than conventional levels. It has further been discovered that the addition of copper, which is known to improve the machinability of other austenitic stainless steels, not only improves the machinability of these low-manganese free-machining austenitic stainless steels, but also significantly improves their corrosion resistance in acid soft drink and beverage syrups. Thus, it is possible to substantially improve the machinability of free-machining austenitic stainless steels containing chromium or chromium-rich sulfides by lowering their carbon plus nitrogen content below conventional levels, and to further improve their machinability and especially their resistance to corrosion in acid soft drink or beverage syrups by increasing their copper content within closely controlled limits.

OBJECTS OF THE INVENTION

It is accordingly a primary object of the present invention to provide a chromium-nickel, free-machining austenitic stainless steel having improved machinability and high resistance to corrosion, especially in acid soft drink or beverage syrups.

An additional object of the invention is to provide a chromium-nickel-copper bearing austenitic stainless having improved machinability and substantially better corrosion resistance, especially in acid soft drink and beverage syrups.

Another object of this invention is to provide machined chromium-nickel austenitic stainless steel fittings and articles with improved machinability and high corrosion resistance, especially in acid soft drink and beverage syrups.

Yet another object of this invention is to provide machined chromium-nickel-copper austenitic stainless steel fittings and articles with substantially improved machinability and excellent corrosion resistance, especially in acid soft drink and beverage syrups.

SUMMARY OF THE INVENTION

In accordance with this invention, it has been discovered that the machinability of chromium-nickel austenitic stainless steels containing chromium or chromium-rich sulfides and with low-manganese up to 0.50% can be greatly improved by reducing their carbon plus nitrogen contents below conventional levels. In this regard, total carbon plus nitrogen in combination at low levels in accordance with the invention is more effective than either low carbon or nitrogen alone. In addition, it has been discovered that the addition of copper to these steels in controlled amounts not only improves machinability, but more importantly significantly improves their corrosion resistance, particularly in the passivated condition, in acid soft drink syrups. The improvements in machinability achieved by reducing carbon plus nitrogen content are obtained both at residual and elevated copper contents. However, the greatest improvements in machinability as well as in the resistance to corrosion in acid soft drinks are obtained with the copper bearing steels of this invention.

The steels of this invention have particular advantage in the application of fittings and articles used for handling and dispensing acid soft drink syrups. With these steels, the decrease in machinability normally associated with the replacement of manganese or manganese-rich sulfides by chromium or chromium-rich sulfides is offset by the lower than conventional carbon plus nitrogen contents and by the addition of copper. Further, the copper bearing steels of this invention exhibit much better corrosion resistance in acid soft drink syrups, which is an additional advantage over prior art steels used in these applications.

In their broad composition range, the steels and machined fittings and articles of this invention consist essentially of the following elements, by weight percent:

carbon plus nitrogen—up to about 0.06% chromium—16 to 20%
nickel—6 to 14%
manganese—up to 0.60%
sulfur—0.15 to 0.50%
phosphorus—up to 0.20%
silicon—up to 1%
molybdenum—up to 1%
iron—balance, except for incidental impurities Carbon and nitrogen are normally present in the steels of this invention, but to obtain the desired improvements in machinability, it is essential in the steels of this invention to control the total carbon plus nitrogen levels below about 0.06% and preferably below about 0.05 or 0.04%.

In general, about 16 to 20% chromium and preferably 17 to 19% chromium is required in the steels of this invention to obtain the required degree of corrosion resistance in acid soft drink syrups and to adjust for the amount of chromium involved in the formation of chromium or chromium-rich sulfides.

About 6 to 14% and preferably 8 to 11% nickel are required in the steels of this invention to obtain an austenitic microstructure and to minimuze austenite transformation during processing operations at ambient temperature.

A maximum of about 0.60% manganese is required to minimize the formation of manganese or manganese-rich sulfides which are known to have an adverse effect on corrosion resistance in acid soft drink syrups and still permit the use of low cost scrap revert melting practices. In applications where maximum resistance to corrosion in acid soft drinks is required, the manganese content must be controlled below about 0.50 and the maximum manganese to sulfur ratio is 1 to 1.

A minimum of about 0.15 and a maximum of about 0.50% of sulfur are needed in the steels of this invention to obtain the desired degree of machinability.

Copper in amounts of about 0.75 to 3.00 and preferably in the amounts of 1.00 to 2.50 is very useful for increasing the stability of the austenite, for improving the machinability, and particularly for increasing the corrosion resistance of the steels of this invention in acid soft drink syrups.

Molybdenum is not necessary in the steels of this invention, but may be used in amounts up to about 1 percent for improving general corrosion resistance.

Silicon and phosphorus, may be present in amounts up to about 1% and 0.20%, respectively, in the steels of this invention. The remainder of the composition is essentially iron, except for incidental impurities usually associated with the production of stainless steels and except for up to 0.01% boron which may be added to improve hot workability.

DETAILED DESCRIPTION OF THE INVENTION AND SPECIFIC EXAMPLES

To demonstrate the invention and specifically the heretofore undisclosed effects of low carbon plus nitrogen and copper in accordance with the invention on machinability and corrosion resistance, fourteen 50-pound laboratory heats were vacuum induction melted and cast into ingots. The ingots were heated to 2200° F. and hot forged to 1¼-inch octagonal shaped bars and air cooled. The bars in turn were annealed by heating to 1950° F., holding at 1950° F. for one hour, and then water quenching. Samples from these bars were machined to one inch square by four inch long specimens for drill machinability testing.

TABLE I

Chemical Composition and Drill Machinability Rating (DMR) of Laboratory Heats
Weight Percent (balance iron)

| Heat Number | C | Mn | P | S | Si | Ni | Cr | Mo | Cu | N | C + N | DMR |
|---|---|---|---|---|---|---|---|---|---|---|---|---|
| V489 | 0.018 | 0.33 | 0.029 | 0.41 | 0.55 | 10.31 | 17.96 | 0.35 | 0.29 | 0.007 | 0.025 | 108 |
| V505 | 0.013 | 0.30 | 0.034 | 0.41 | 0.54 | 10.34 | 18.20 | 0.35 | 0.29 | 0.024 | 0.037 | 106 |
| V560 | 0.026 | 0.34 | 0.030 | 0.38 | 0.55 | 10.41 | 18.35 | 0.35 | 0.28 | 0.20 | 0.046 | 106 |
| V603 | 0.048 | 0.33 | 0.028 | 0.41 | 0.52 | 10.39 | 18.20 | 0.35 | 0.29 | 0.005 | 0.053 | 105 |
| V603A | 0.064 | 0.34 | 0.029 | 0.41 | 0.52 | 10.42 | 18.42 | 0.35 | 0.28 | 0.010 | 0.074 | 104 |
| V506 | 0.020 | 0.30 | 0.033 | 0.39 | 0.55 | 10.37 | 18.28 | 0.35 | 0.28 | 0.059 | 0.079 | 100 |
| V541 | 0.015 | 0.35 | 0.029 | 0.39 | 0.55 | 10.13 | 18.25 | 0.35 | 0.28 | 0.091 | 0.106 | 98 |
| V563 | 0.017 | 0.35 | 0.030 | 0.39 | 0.54 | 10.39 | 18.20 | 0.35 | 0.75 | 0.016 | 0.033 | 104 |
| V508 | 0.020 | 0.33 | 0.032 | 0.39 | 0.55 | 9.31 | 18.28 | 0.35 | 1.24 | 0.029 | 0.049 | 112 |
| V507 | 0.021 | 0.32 | 0.031 | 0.39 | 0.55 | 10.48 | 18.13 | 0.35 | 1.26 | 0.023 | 0.044 | 109 |
| V564 | 0.018 | 0.36 | 0.030 | 0.40 | 0.53 | 10.29 | 18.42 | 0.34 | 1.79 | 0.021 | 0.039 | 109 |
| V567 | 0.020 | 0.59 | 0.035 | 0.42 | 0.56 | 10.84 | 18.08 | 0.35 | 2.24 | 0.012 | 0.032 | 114 |
| V568 | 0.021 | 0.57 | 0.035 | 0.41 | 0.56 | 10.64 | 18.04 | 0.73 | 2.25 | 0.023 | 0.044 | 113 |
| V565 | 0.021 | 0.34 | 0.029 | 0.36 | 0.53 | 10.35 | 18.03 | 0.34 | 2.29 | 0.025 | 0.046 | 112 |

Table I lists the resulting chemical compositions of the laboratory heats. Other than variations in carbon, nitrogen, manganese, molybdenum and copper, all the alloys are essentially 0.40 percent sulfur, 18-percent-chromium, 10 percent nickel, free-machining austenitic stainless steels.

The machinability of the experimental alloys of Table I was evaluated using the aforementioned test specimen and a drill machinabilty test. In the drill machinability test, the total time taken to drill a specified number of holes to a specified depth in the material to be evaluated is compared to the total time to drill the same number of holes to the same depth in a material having known, established machining characteristics. The ratio between the time taken to drill the established material and the time taken to drill the test material multiplied by 100 provides a drill machinability rating (DMR) for the test material. Specific conditions used for these tests were as follows:

Drills—¼ inch diameter high speed steel jobber bits
Drill Speed—405 revolutions per minute
Load on Drill—14.2 pounds
Break-in Hole Depth—0.1 inch
Timed Hole Depth—0.3 inch $$\text{Drill Machinability Rating (DMR)} = \frac{\text{Time to drill established steel}}{\text{Time to drill test steel}} \times 100$$

Heat number V506 containing 0.079 percent carbon plus nitrogen, about the concentrations of these elements in a typical steel of this type, was assigned a DMR of 100. Thus, steels having DMR values of greater than 100 have better drill machinability than conventional, typical steels of this type; and values less than 100, poorer drill machinability. Also, increasing DMR values indicate improved drill machinability.

Table I presents the results of one drill machinability testing of the laboratory steels. Allowing for some experimental scatter in the data and considering the steels containing about 0.30 percent copper and 0.025 to 0.106 percent carbon plus nitrogen, i.e., heat number V489, V505, V560, V603, V603A, V506, and V541, it is clearly evident that lowering the total combination of carbon plus nitrogen content of the steel results in improved drill machinability. Steels within the scope of the invention, i.e., heat number V489, V505, V560, and V603, all display improved machinability compared to heat number V506.

The data in Table I also show that heat numbers V560 and V603, which have similar carbon plus nitrogen contents of about 0.05%, have similar drill machinability despite the fact that the carbon contents of the heats are respectively below and above the critical value of 0.035% specified in U.S. Patent 3,902,398 for stainless steels of this type. A like result is obtained when comparing the drill machinability of heats V506 and V603A, which have similar carbon plus nitrogen contents of about 0.075% and carbon contents respectively below and above the critical value of 0.035% specified in the above patent. Thus, carbon plus nitrogen content is more critical than carbon content in regard to the machinability of the low manganese austenitic stainless steels of this invention.

At an equivalent carbon plus nitrogen content, adding at least 1.24 percent copper to the invention steels results in still further improvements in machinability as illustrated by heat numbers V508, V507, V564, V567, and V565. A molybdenum addition to heat number V568 appears to have essentially no effect on drill machinability when compared to heat number V567 containing a similar amount of copper but less molybdenum and slightly less carbon plus nitrogen.

An empirical test in a commercial acid soft drink syrup sold under the registered tradename SPRITE was conducted to compare the corrosion resistance of heat numbers V505, V506, V562, V507, V508, V564, and V565 with those disclosed in U.S. Pat. No. 3,902,348, and AISI Type 303 stainless. In this test, six-inch lengths of the bars produced from these stainless steels and the AISI Type 303 were milled to the bar centers in order to obtain chips that were representative of the entire bar cross section. Ten grams of both as-machined and passivated (50% nitric acid plus 2% sodium dichromate) chips were then immersed in 50 milliliters (ml) of SPRITE syrup (pH-3) for five days. During this period of exposure, hydrogen sulfide ($H_2S$) gas generation was monitored with moistened lead acetate test paper. The color changes in the lead acetate paper, if any, were recorded and rated visually in regard to the degree of $H_2S$ evolution according to the following system: 0 —None, 1 —very light, 2 —light, 3 —moderate, 4 —heavy, 5 —very heavy. Also, at the end of the five day test period, the syrups were separated from the chips and diluted to 200 ml with deionized water. The dilute syrups were then analyzed for iron, manganese, nickel, chromium and copper ions. The results of all the soft drink syrup tests are given in Table II.

TABLE II

Hydrogen Sulfide Generation and SPRITE Syrup Analysis Test Results on Machined Chips

| Heat | Composition | | | | | Average Lead Acetate Test Paper Rating[a] | | SPRITE Syrup Analysis Total Metal Ions Fe, Mn, Ni, Cr, Cu - ppm | |
|---|---|---|---|---|---|---|---|---|---|
| Number | C + N | Mn | S | Ni | Cu | As-Machined | Passivated[b] | As-Machined | Passivated[b] |
| V505 | 0.037 | 0.30 | 0.41 | 10.34 | 0.29 | 0.1 | 0.2 | 78 | 57 |
| V506 | 0.079 | 0.30 | 0.39 | 10.37 | 0.29 | 0.3 | 0.2 | 74 | 57 |
| V562 | 0.033 | 0.35 | 0.39 | 10.39 | 0.75 | 0.2 | 0.4 | 71 | 58 |
| V507 | 0.044 | 0.32 | 0.39 | 10.48 | 1.26 | 0 | 0 | 63 | 49 |
| V508 | 0.049 | 0.33 | 0.39 | 9.31 | 1.24 | 0 | 0 | 63 | 45 |
| V564 | 0.039 | 0.36 | 0.40 | 10.29 | 1.79 | 0 | 0 | 65 | 47 |
| V565 | 0.046 | 0.34 | 0.36 | 10.35 | 2.29 | 0 | 0 | 70 | 36 |
| A-15596 | 0.081 | 1.70 | 0.32 | 8.85 | 0.21[c] | 5 | 2.1 | 330 | 120 |

[a]Lead Acetate Test Paper Ratings = 0 - None, 1 - Very Light, 2 - Light, 3 - Moderate, 4 - Heavy, 5 - Very Heavy
[b]Passivated (treated) in a solution of 20% nitric acid and 2% sodium dichromate for 30 minutes at 150° F.
[c]Commercial AISI Type 303 stainless.

The results of the lead acetate paper monitoring of $H_2S$ generation and of the syrup analyses indicate that increasing the copper content of the low manganese-chromium-nickel, free-machining stainless steels of this invention to above about 0.75% and particularly from 1.26 to 2.29% significantly improves their resistance to corrosion in SPRITE soft drink syrup, especially in the passivated condition. This effect of copper is most clearly evidence by heat numbers V507, V564, and V565 which contain 1.26, 1.79, and 2.29% copper, respectively, and which show essentially no $H_2S$ evolution during testing and significantly less contamination of the SPRITE soft drink syrup than do similar steels with residual copper, such as Heat V506, and much less than AISI Type 303, as represented by heat number A-15596. Thus, the low carbon plus nitrogen, low manganese, copper bearing austenitic stainless steels of this invention exhibit much better resistance to corrosion in acid soft drink syrups than do prior art steels of this general type.

What is claimed is:

1. A low carbon plus nitrogen, free-machining, austenitic stainless steel having improved machinability and excellent resistance to corrosion in acid soft drink syrups, especially in the passivated condition, said steel consisting essentially of, by weight percent carbon plus nitrogen up to about 0.05
chromium 16 to 20
nickel 6 to 14
manganese up to 0.60
sulfur 0.15 to 0.50
silicon up to about 1
phosphorus up to about 0.20
molybdenum up to about 1.0
and remainder iron except for incidental impurities.

2. The steel of claim 1 having carbon plus nitrogen up to about 0.04.

3. The steels of claim 2 having from about 0.75 copper.

4. The steels of claim 2 having 1.00 to 2.50 copper.

5. A low carbon plus nitrogen, free-machining, austenitic stainless steel having improved machinability and excellent resistance to corrosion in acid soft drink syrups, especially in the passivated condition, said steel consisting essentially of, by weight percent carbon plus nitrogen up to about 0.05
chromium 17 to 19
nickel 8 to 11
manganese up to 0.50
sulfur 0.15 to 0.50
silicon up to about 1
phosphorus up to about 0.20
and remainder iron except for incidental impurities and wherein the maxium manganese to sulfur ratio is 1 to 1.

6. The steel of claim 5 having carbon plus nitrogen up to about 0.04.

7. The steels of claims 5 or 6 having from about 0.75 to 3.00 copper.

8. The steel of claims 5 or 6 having from 1.00 to 2.50 copper.

9. Machined austenitic stainless steel fittings and articles characterized by having improved machinability and resistance to corrosion in acid soft drink syrups, especially in the passivated condition, said fittings and articles consisting essentially of, by weight percent carbon plus nitrogen up to about 0.05
chromium 16 to 20
nickel 6 to 14
manganese up to 0.60
sulfur 0.15 to 0.50
silicon up to about 1
phosphorus up to about 0.20
molybdenum up to about 1
and remainder iron except for incidental impurities.

10. The machined austenitic stainless steel fittings and articles of claim 9 having carbon plus nitrogen up to about 0.04.

11. The machined austenitic stainless steel fittings and articles of claims 9 or 10 having from about 0.75 to 3.00 copper.

12. The machined austenitic stainless fittings and articles of claims 9 or 10 having from 1.00 to 2.50 copper.

13. Machined austenitic stainless steel fittings and articles characterized by having improved machinability and improved resistance to corrosion in acid soft drink syrups in the passivated condition, said fittings and articles consisting essentially of, by weight percent carbon plus nitrogen up to about 0.05
chromium 17 to 19
nickel 8 to 11
manganese up to 0.50
sulfur 0.15 to 0.50
silicon up to about 1
phosphorus up to about 0.20
molybdenum up to 1
and remainder iron except for incidential impurities and wherein the maximum manganese to sulfur ratio is 1 to 1.

14. The machined austenitic stainless steel fittings and articles of claim 13 having carbon plus nitrogen up to about 0.04.

15. The machined austenitic stainless steel fittings and articles of claims 13 or 14 having from about 0.75 to 3.00 copper.

16. The machined austenitic stainless steel fittings and articles of claims 13 or 14 having 1.00 to 2.50 copper.

* * * * *

UNITED STATES PATENT AND TRADEMARK OFFICE

CERTIFICATE OF CORRECTION

PATENT NO. : 4,933,142

DATED : June 12, 1990

INVENTOR(S) : Walter T. HASWELL, JR., et al.

It is certified that error appears in the above-identified patent and that said Letters Patent is hereby corrected as shown below:

Claim 1, column 6, line 58, delete ", especially".

Claim 3, column 7, line 3, delete "claim 2" and insert --claims 1 or 2--; and after "0.75" insert --to 3.00--.

Claim 4, column 7, line 5, delete "claim 2" and insert --claims 1 or 2--.

Claim 5, column 7, line 9, delete ", especially".

Claim 9, column 7, line 31, delete ", especially".

Signed and Sealed this

Eighth Day of October, 1991

*Attest:*

HARRY F. MANBECK, JR.

*Attesting Officer*

*Commissioner of Patents and Trademarks*